US005625966A

United States Patent [19]

Perotto et al.

[11] Patent Number: 5,625,966

[45] Date of Patent: May 6, 1997

[54] HIGHLY FLEXIBLE ITEM OF SPORTS FOOTWEAR

[75] Inventors: Riccardo Perotto, Volpago del Montello; Giuliano Zavan, Treviso, both of Italy

[73] Assignee: Nordica S.P.A., Trevignano, Italy

[21] Appl. No.: 629,908

[22] Filed: Apr. 10, 1996

Related U.S. Application Data

[63] Continuation of Ser. No. 341,619, filed as PCT/EP94/00688, Mar. 8, 1994 published as WO94/21148, Sep. 29, 1994, abandoned.

[30] Foreign Application Priority Data

Mar. 18, 1993 [IT] Italy ..... MI93A0512

[51] Int. Cl.[6] ..... A43B 5/04

[52] U.S. Cl. ..... 36/117.2; 36/102; 36/103; 36/25 R; 36/31

[58] Field of Search ..... 36/117.2, 88, 102, 36/103, 120, 25 R, 28, 37, 33, 45, 29, 114

[56] References Cited

U.S. PATENT DOCUMENTS

| | | | |
|---|---|---|---|
| 1,088,328 | 2/1914 | Cucinotta | 36/28 |
| 2,340,027 | 1/1944 | Story | 36/33 |
| 2,458,602 | 1/1949 | Johnson | 36/117 X |
| 2,950,118 | 8/1960 | Sharpe | 36/117 X |
| 4,616,431 | 10/1986 | Dassler | 36/28 |
| 4,677,769 | 7/1987 | Ahmad et al. | 36/120 X |
| 4,937,955 | 7/1990 | Bonaventure | 36/117 X |

FOREIGN PATENT DOCUMENTS

| | | | |
|---|---|---|---|
| 0096094 | 12/1983 | European Pat. Off. . | |
| 0234908 | 9/1987 | European Pat. Off. . | |
| 2478441 | 9/1981 | France . | |
| 0033492 | 6/1908 | Germany | 36/28 |
| 400538 | 11/1922 | Germany | 36/117 |
| 2752491 | 11/1977 | Germany . | |
| 479265 | 11/1969 | Switzerland . | |
| 03225 | 8/1984 | WIPO . | |
| 19117 | 11/1992 | WIPO . | |

*Primary Examiner*—M. D. Patterson
*Attorney, Agent, or Firm*—Herbert Dubno

[57] ABSTRACT

A highly flexible item of sports footwear in which the bottom of the toe portion of the upper and the toe portion of the sole member define a free space in the form of a wedge-shaped gap which is sealed by a bellows extending around the periphery of the toe portion of the upper. The toe portion of the sole member has a unidirectional articulation enabling displacement of the toe portion of the sole member upwardly out of coplanarity with the plantar articulation portion of the sole member.

9 Claims, 3 Drawing Sheets

HIGHLY FLEXIBLE ITEM OF SPORTS FOOTWEAR

CROSS REFERENCE TO RELATED APPLICATION

This is a continuation of application Ser. No. 08/341,619 filed 23 Jan. 1995, now abandoned.

This application is a national phase of PCT/EP94/00688 filed 8 Mar. 1994 and based, in turn, upon Italian national application MI 93A000512 of 18 Mar. 1993, under the International Convention.

FIELD OF THE INVENTION

The present invention relates to a highly flexible item of sports footwear.

BACKGROUND OF THE INVENTION

As is known, footwear used for some specific skiing techniques, such as the so-called "telemark" and "cross-country" techniques, must have particular technical characteristics that ensure optimum longitudinal flexing of the item of footwear and excellent resistance to lateral torsion while allowing even prolonged use of the item of footwear on mixed terrain, uphill and downhill, and maintaining excellent comfort for the user's foot, and must ensure lateral support and precise transmission of movements to the ski.

However, current items of footwear for such purposes are not free of drawbacks.

For example, compression often occurs on the metatarsal region during the flexing of a known shoe due to the corrugation of the upper of the item of footwear, consequently reducing the comfort of the item of footwear.

Furthermore, in footwear of this type the flexibility and tilt of the item of footwear are almost exclusively entrusted to the elastic characteristics of the materials used to manufacture it, and particularly to the sole of the item, in order to ensure both precise ski control when turning and high resistance to lateral torsion and to flexibility in the metatarsal region.

Obviously, since the materials employed must simultaneously have several different requirements to ensure good technical performance, the consequent result is always poor.

OBJECTS OF THE INVENTION

The object of the present invention is to eliminate the drawbacks described above by providing a highly flexible item of sports footwear that provides considerable comfort since compressions of the metatarsal region during its flexing are eliminated.

An important object of the invention is to provide an item of sports footwear that allows variation in flexibility and tilt according to the user's requirements.

Another object of the invention is to provide an item of sports footwear that has excellent rear support and enormously facilitates rolling of the foot while the user is walking.

Another object of the invention is to provide an item of sports footwear that can be advantageously assembled with known processes involving gluing, direct injection or mechanical assembly, with a rigid or partially rigid shell or with a conventional leather upper, preserving the main characteristics of an extremely high degree of flexing and tilting.

Another object of the invention is to provide a highly flexible item of sports footwear which can be industrially fabricated, so as to reduce its production costs and facilitate its sale to the public.

SUMMARY OF THE INVENTION

These objects and others are achieved by a highly flexible item of sports footwear, characterized in that it comprises, in a front portion, at the axis of natural flexing of the foot, a first unidirectional articulation means for the gradual tilting of at least the upper of the item of footwear with respect to the sole thereof, a first flexible means being furthermore provided between the upper and the sole to vary the value of the flexing of the item of footwear.

BRIEF DESCRIPTION OF THE DRAWING

The above and other objects, features, and advantages will become more readily apparent from the following description, reference being made to the accompanying drawing in which.

SPECIFIC DESCRIPTION

Figure 9:
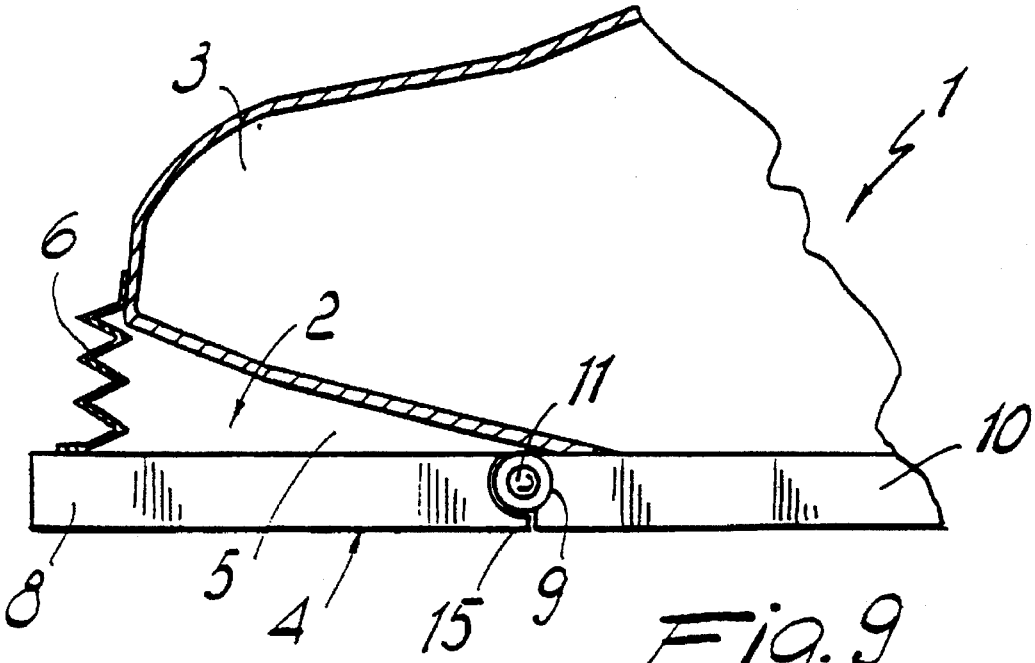
FIG. 9 is a schematic partial sectional view of the front part of the item of footwear, illustrating the first and second means for its articulation.

With particular reference to the above described figures, the highly flexible item of sports footwear according to the present invention, generally designated by the reference numeral 1, comprises, in a front portion, a first unidirectional articulation means, generally designated by the reference numeral 2 (FIG. 9), which is conveniently arranged at the natural flexing axis of the foot to allow the gradual tilting of the upper 3 with respect to the sole 4 of the item of footwear.

The first articulation means 2 is formed by a recess in the material in a downward region of the front portion of the bottom of the upper, so that the upper forms, together with the sole 4, an empty wedge-shaped space 5 that facilitates the inclination of the front part of the upper and thus the flexing of the item of footwear.

This solution facilitates ideal support of the skier and provides the fastest possible weight shifting, avoiding compressions of the upper on the metatarsal region of the skier due essentially to the corrugation of the upper.

A first flexible means is furthermore provided between the upper 3 and the sole 4 and comprises a bellows-like part 6, preferably made of plastic, that is connected to the front portion of the upper 3 at one end and to the sole 4 at the opposite end, so as to sealingly close the wedge-shaped space 5.

Obviously, depending on the type of material and the structure used to provide the bellows-like part 6, it is possible to modify at will the value of the reaction force that acts when the upper 3 moves toward the sole 4.

In order to avoid relying exclusively on the elasticity of the material of the sole for the flexing thereof toward the front portion of the upper 3, on the sole, proximate to the first articulation means 2, there is at least a second unidirectional articulation means which is suitable to cooperate with the first articulation means to vary the flexibility and the tilt of the item of footwear.

Figure 1:
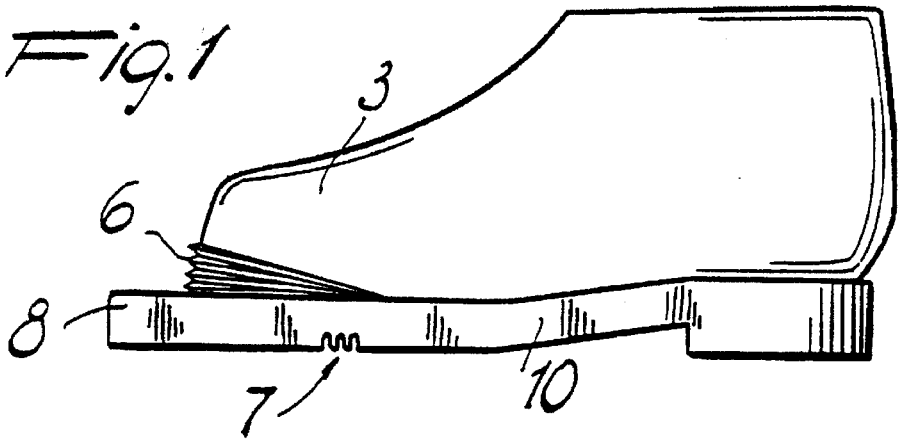
FIGS. 1, 2, 3 and 4 are schematic side elevational views of the item of sports footwear according to the invention.
Figure 2:
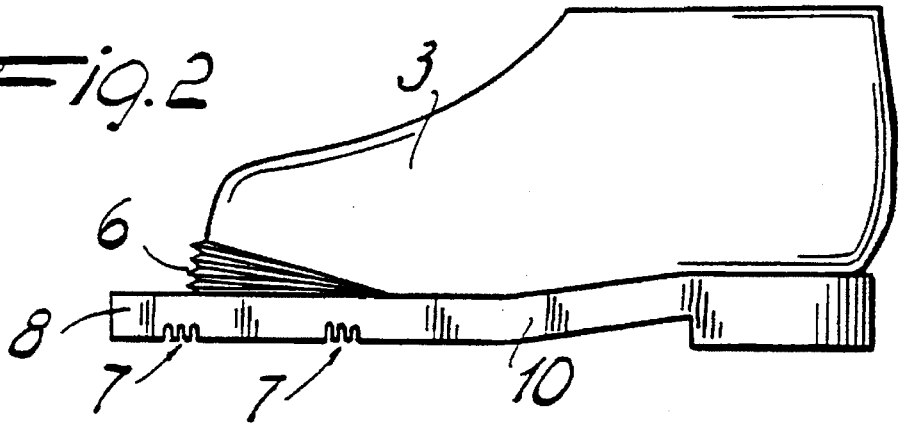
Figure 3:
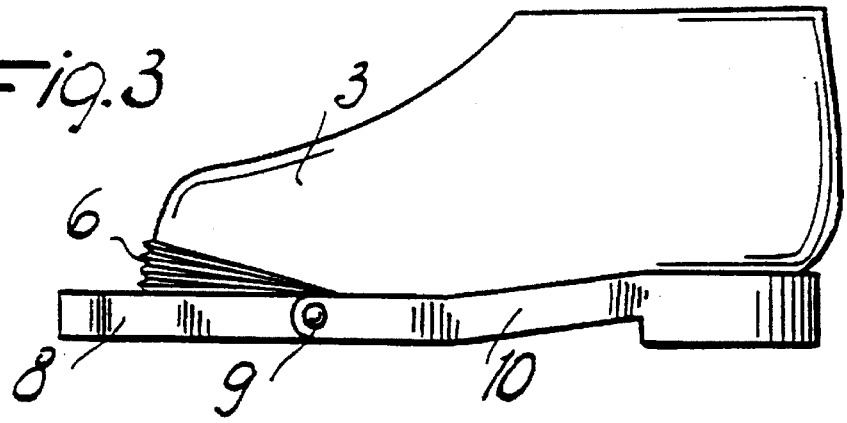
Figure 4:
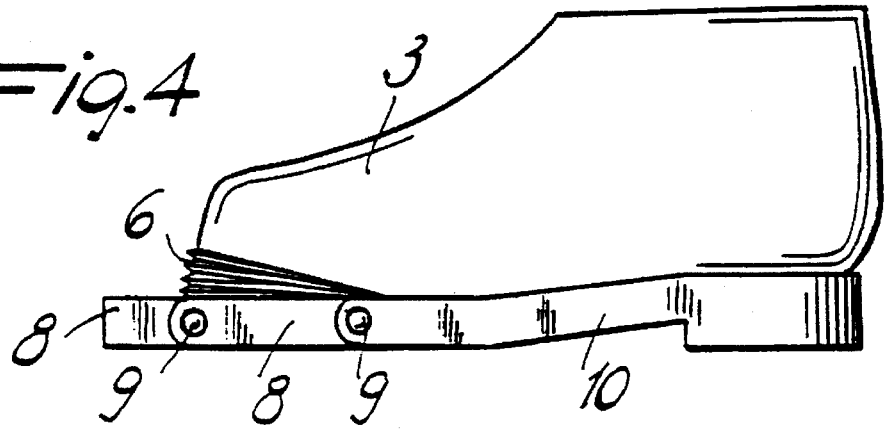
Figure 5:
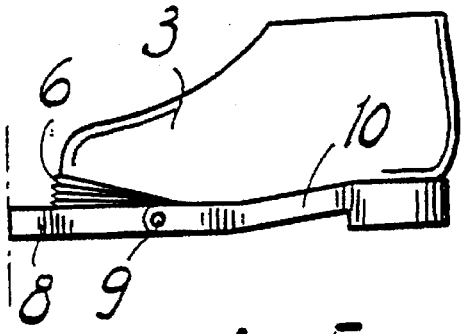
FIGS. 5, 6, 7 and 8 are schematic side elevational views of the gradual inclination of the upper of the item of footwear with respect to the sole thereof, according to the invention.
Figure 6:
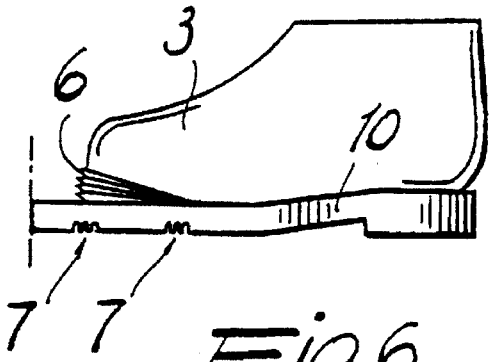
Figure 7:
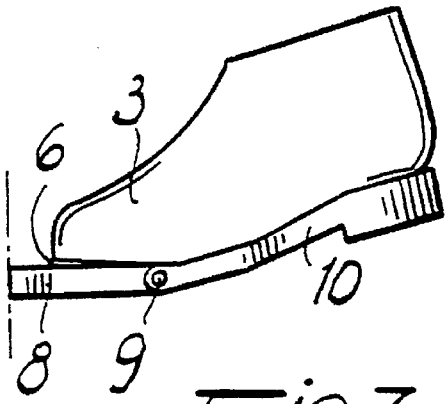
Figure 8:
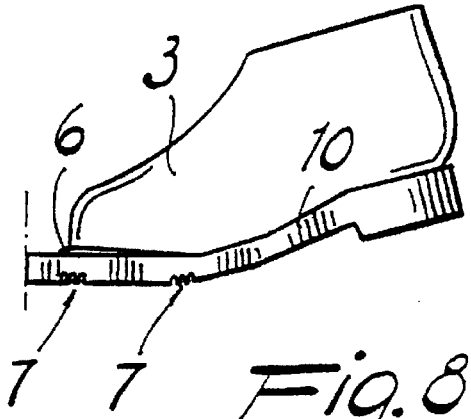

Particularly, the second articulation means can include, as shown in FIGS. 1 and 2, one or more easy-flexing regions 7 that are formed on the sole by providing one or more notches.

In a different embodiment, the second articulation means comprises a tip 8 which is hinged, by virtue of a hinge 9, to the plantar arch 10 of the sole, the hinge having a pivot 11.

Figure 10:
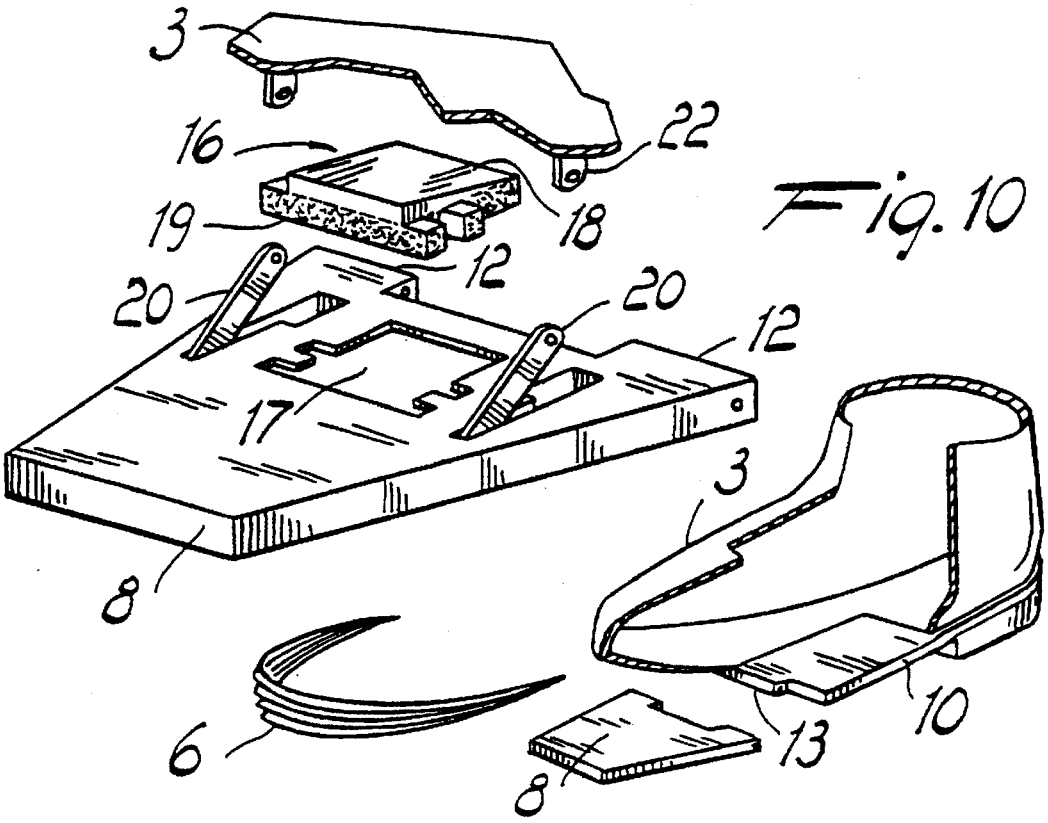
FIG. 10 is an exploded perspective detail view of the first and second articulation means according to the invention.

The pivot 11 engages respective holes formed on two wings 12 of the tip 8 and a central expansion 13 which lies between the wings 12 and extends from the plantar arch 10 (FIG. 10).

In this manner, the second articulation means allows high resistance to lateral torsion and considerable precision in transmitting the movements from the shoe to the ski.

Conveniently, the wings 12 have a retention block or abutment 15 (FIG. 9) that allows the tip 8 to rotate toward the upper 3 of the item of footwear but not in the opposite direction, when the tip is perfectly co-planar with respect to the plantar arch 10.

In addition to the bellows-like part 6, the item of footwear can have a second flexible means that includes a block 16 which is accommodated in a corresponding seat 17 formed on the sole 4 and particularly, as shown in FIG. 10, in the tip 8.

Conveniently, the block 16 is also wedge-shaped so as to follow the wedge-like shape of the space 5.

Conveniently, the block 16 comprises at least two regions 18 and 19 offering different resistance to the compression force that occurs between the front portion of the upper 3 and the sole 4 during the flexing and tilting of the item of footwear.

In this manner, by virtue of the two regions 18 and 19 and the bellows-like part 6, it is possible to vary at will, and according to the user's requirements, the characteristics of flexing and longitudinal tilting of the item of footwear, so as to enhance its technical performance and its excellent comfort even with prolonged use on mixed terrain.

The item of footwear furthermore has at least one locking part and particularly two links or arms 20 which are hinged to the tip 8 at one end and to downwardly extending lugs of the front portion of the upper 3 at the opposite end.

As can be easily understood, the links 20 cooperate with the retention block 16 if the tip 8 is articulated to the plantar arch 10.

If instead the sole 4 is provided with flexing regions 7, as shown for example in FIGS. 1 and 2, the links 20 allow locking of the front portion of the upper with respect to the sole in a position for the maximum opening of the wedge-like space 5.

Figure 11:
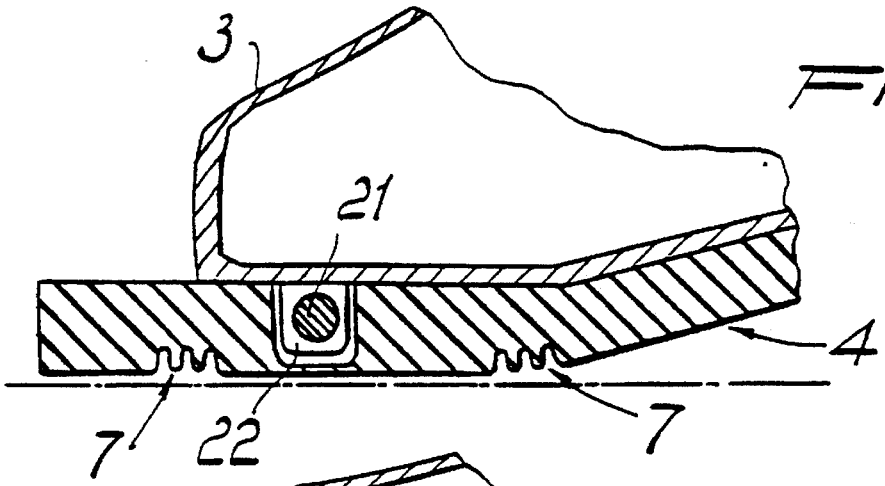
FIGS. 11 and 12 are schematic cross sectional views of the part for connecting the front portion of the upper and the sole to allow easy rolling for walking.
Figure 12:
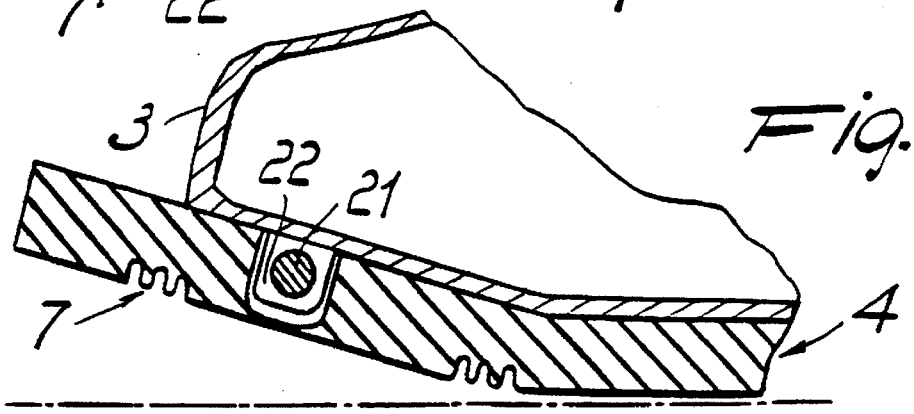

It should also be added that in order to facilitate walking, the item of footwear according to the present invention has a part for connecting the front portion of the upper 3 to the sole 4 in a position in which the wedge-shaped space 5 is completely closed, as shown in FIGS. 11 and 12.

Particularly, the connecting part can be formed by a pin or pintle 21 that simultaneously engages a hole that passes inside the sole 4 and the holes formed in two lugs or wings 22 provided on the upper 3.

The operation of the item of footwear according to the invention is evident from what has already been described and illustrated; particularly, the fact is stressed that the rotation axis located in a downward region of the tip of the foot allows the best control of the ski and effective transmission of efforts between the shoe and the ski, eliminating any energy dispersion.

The devised solution allows the flexibility and inclination of the item of footwear and ensures excellent lateral stability and resistance to torsion with exceptional comfort, since the compressions produced by the upper on the metatarsal region during the flexing of the item of footwear are eliminated.

Furthermore, advantageously, the item of footwear allows to adjust the value of its flexibility and inclination, of its rear support and of its rolling action for walking.

An additional advantage provided by the solution is that it can be assembled, with known processes involving gluing, direct injection or mechanical assembly, to any item of footwear obtained from an upper or rigid or partially rigid shell or to a conventional item of footwear while maintaining the above mentioned main characteristics of flexing and inclination.

The invention thus conceived is susceptible to numerous modifications and variations, all of which are within the scope of the inventive concept; all the details may furthermore be replaced with technically equivalent elements.

In practice, the materials employed, as well as the dimensions, may be any according to the requirements and the state of the art.

Where technical features mentioned in any claim are followed by reference signs, those reference signs have been included for the sole purpose of increasing the intelligibility of the claims and accordingly such reference signs do not have any limiting effect on the scope of each element identified by way of example by such reference signs.

We claim:

1. A highly flexible item of footwear comprising:

a sole member having a heel portion, a plantar arch portion adjoining said heel portion and a toe portion adjoining said plantar arch portion and connected thereto by a unidirectional articulation extending across an entire width of said sole member enabling displacement of said toe portion of the sole member upwardly out of coplanarity with said plantar arch portion about said unidirectional articulation;

an upper on said sole member having a toe portion with a bottom extending upwardly away from said plantar arch portion and defining an empty wedge-shaped gap with said toe portion of said sole member, said wedge-shaped gap varying in height from a maximum when said toe portion of said sole member is coplanar with said plantar arch portion to a minimum when said toe portion of said sole member is proximal to said bottom of said toe portion of said upper; and a bellows attached to said toe portions around a periphery of said wedge-shaped gap to seal said wedge-shaped gap from the exterior, said bellows contracting upon displacement of said toe portion of said sole member relative to said toe portion of said upper to vary said height from said maximum to said minimum, said toe portion of said sole member being flat and extending under said bellows beyond said toe portion of said upper and being substantially coplanar with said plantar arch portion upon reaching maximum of height of said wedge-shaped gap.

2. The item of footwear defined in claim 1, further comprising a second articulation along said toe portion of said sole member and a tip thereof.

3. The item of footwear defined in claim 1 wherein said articulation is a portion of said sole member formed with at least one notch.

4. The item of footwear defined in claim 1 wherein said articulation is a hinge formed by a central projection of said plantar arch portion and a pair of wings on said toe portion of said sole member flanking said projection, and a pintle extending through said wings and said central portion.

5. The item of footwear defined in claim 4, further comprising a second articulation along said toe portion of said sole member and a tip thereof.

6. The item of footwear defined in claim 5 wherein said second articulation is a further hinge.

7. The item of footwear defined in claim 1 wherein said toe portion of the upper is shorter than both said plantar arch portion and said toe portion of the sole respectively.

8. A highly flexible item of footwear comprising:

a sole member having a heel portion, a plantar arch portion adjoining said heel portion and a toe portion adjoining said plantar arch portion and connected thereto by a unidirectional articulation enabling displacement of said toe portion of the sole member upwardly out of coplanarity with said plantar arch portion about said unidirectional articulation;

an upper on said sole member having a toe portion with a bottom extending upwardly away from said plantar arch portion and defining an empty wedge-shaped gap with said toe portion of said sole member, said wedge-shaped gap varying in height from a maximum when said toe portion of said sole member is coplanar with said plantar arch portion to a minimum when said toe portion of said sole member is proximal to said bottom of said toe portion of said upper;

a bellows attached to said toe portions around a periphery of said wedge-shaped gap to seal said wedge-shaped gap from the exterior, said bellows contracting upon displacement of said toe portion of said sole member relative to said toe portion of said upper to vary said height from said maximum to said minimum; and means for locking said toe portion of said upper with respect to said toe portion of said sole member when said wedge-shaped gap is at said maximum height.

9. A highly flexible item of footwear comprising:

a sole member having a heel portion, a plantar arch portion adjoining said heel portion and a toe portion adjoining said plantar arch portion and connected thereto by a unidirectional articulation enabling displacement of said toe portion of the sole member upwardly out of coplanarity with said plantar arch portion about said unidirectional articulation;

an upper on said sole member having a toe portion with a bottom extending upwardly away from said plantar arch portion and defining an empty wedge-shaped gap with said toe portion of said sole member, said wedge-shaped gap varying in height from a maximum when said toe portion of said sole member is coplanar with said plantar arch portion to a minimum when said toe portion of said sole member is proximal to said bottom of said toe portion of said upper;

a bellows attached to said toe portions around a periphery of said wedge-shaped gap to seal said wedge-shaped gap from the exterior, said bellows contracting upon displacement of said toe portion of said sole member relative to said toe portion of said upper to vary said height from said maximum to said minimum; and means for locking said toe portions together with said wedge-shaped gap completely closed.

* * * * *